US011086267B2

(12) United States Patent
Tanabe et al.

(10) Patent No.: US 11,086,267 B2
(45) Date of Patent: Aug. 10, 2021

(54) IMAGE FORMING APPARATUS AND DEVELOPING CARTRIDGE

(71) Applicant: CANON KABUSHIKI KAISHA, Tokyo (JP)

(72) Inventors: Masato Tanabe, Susono (JP); Masakazu Tatsumi, Susono (JP); Tatsuro Harada, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/570,860

(22) Filed: Sep. 13, 2019

(65) Prior Publication Data

US 2020/0096935 A1 Mar. 26, 2020

(30) Foreign Application Priority Data

Sep. 25, 2018 (JP) ..... JP2018-178956
Sep. 25, 2018 (JP) ..... JP2018-178957

(51) Int. Cl.
*G03G 21/16* (2006.01)

(52) U.S. Cl.
CPC ..... *G03G 21/1647* (2013.01); *G03G 21/1676* (2013.01)

(58) Field of Classification Search
CPC ..... G03G 21/1825; G03G 21/185; G03G 21/1647
See application file for complete search history.

(56) References Cited

U.S. PATENT DOCUMENTS

2009/0238603 A1* 9/2009 Kusudo ..... G03G 21/1825 399/111
2012/0321342 A1* 12/2012 Mori ..... G03G 21/1825 399/111
2017/0031312 A1* 2/2017 Seto ..... G03G 21/185
2017/0248905 A1* 8/2017 Anan ..... G03G 21/1846
2017/0248906 A1* 8/2017 Tanabe ..... G03G 21/1825

FOREIGN PATENT DOCUMENTS

JP 2003241622 A 8/2003
JP 2017173805 A 9/2017

* cited by examiner

*Primary Examiner* — Walter L Lindsay, Jr.
*Assistant Examiner* — Jessica L Eley
(74) *Attorney, Agent, or Firm* — Canon U.S.A., Inc. I.P. Division

(57) ABSTRACT

An image forming apparatus including a photosensitive member, a developing cartridge that has a developing member, a developing frame, an end member attached to the developing frame, and a restricting portion restricting a swing movement of the end member, and an apparatus body to which the developing cartridge is attachable. The apparatus body includes a movement unit moving the developing cartridge from a first position to a second position, a positioning portion engaging with the end member when the developing cartridge is located at the second position, and a restriction releasing portion acting on the restricting portion with a movement of the developing cartridge from the first position to the second position and releasing restriction of the swing movement of the end member, the restriction releasing portion being provided at a part of the apparatus main body excluding the movement unit.

10 Claims, 15 Drawing Sheets

IMAGE FORMING APPARATUS AND DEVELOPING CARTRIDGE

BACKGROUND OF THE INVENTION

Field of the Invention

The present invention relates to an electrophotographic image forming apparatus and a developing cartridge usable in the image forming apparatus. The electrophotographic image forming apparatus includes a printer (laser beam printer, light-emitting diode (LED) printer, etc.), a copying machine, a facsimile apparatus, a word processor, and a multifunctional peripheral thereof (multifunction printer).

Description of the Related Art

A developing cartridge that includes a developing unit supporting a developing roller and end members attached to respective longitudinal ends of the developing unit so as to be rotatable with respect to the developing unit has been available (Japanese Patent Application Laid-Open No. 2017-173805). Positioning of the end members in an apparatus body enables the developing unit to rotate with respect to a photosensitive drum the position of which has been set in the apparatus body. This configuration enables the developing unit to move between a contact position at which the developing roller is in contact with the photosensitive drum and a separated position at which the developing roller is separated from the photosensitive drum. The developing cartridge includes a restricting member that restricts a rotation of the developing unit with respect to the end members in attaching to or detaching from the apparatus body.

In the developing cartridge discussed in Japanese Patent Application Laid-Open No. 2017-173805, restriction of the rotation for the end members with respect to the developing unit is released by an operation of moving the developing cartridge in a rotation axis direction of the developing roller, with respect to the apparatus body. In an image forming apparatus in which the developing cartridge moves between a first position for attachment and detachment of the developing cartridge and a second position for an image formation, the restriction of the rotation for the end members is released at the first position. Rotation of the end members is desirably restricted at the first position at which the image formation is not performed.

SUMMARY OF THE INVENTION

According to a first aspect of the present invention, an image forming apparatus forming a toner image on a recording medium, includes a photosensitive member configured to carry the toner image, a developing cartridge, not including the photosensitive member, the developing cartridge including, a developing member configured to supply toner to the photosensitive member, a developing frame supporting the developing member so that the developing member is rotatable about a rotation axis, an end member attached to an end of the developing frame in a direction of the rotation so that the end member is swingable with respect to the developing frame, wherein a swing axis of the end member extends in a direction along the rotation axis, and a restricting portion configured to restrict a swing movement of the end member, and an apparatus body which the developing cartridge is attachable to and detachable from in the direction of the rotation axis. The apparatus body includes a movement unit configured to move the developing cartridge from a first position to a second position, the first position being a position for attachment and detachment of the developing cartridge to and from the apparatus body, the second position being a position for an image formation, a positioning portion configured to engage with the end member so that a position of the end member in a swing direction of the end member about the swing axis with respect to the apparatus body is set in a case where the developing cartridge is located at the second position, and a restriction releasing portion configured to release restriction of the swing movement of the end member by acting on the restricting portion with a movement of the developing cartridge from the first position to the second position along with a movement of the movement unit, the restriction releasing portion being provided at a part of the apparatus main body excluding the movement unit. The end member is attached to an upstream-side end, in a mounting direction, of the developing frame, the mounting direction being a direction in which the developing cartridge is mounted to the apparatus body.

According to a second aspect of the present invention, a developing cartridge attachable to and detachable from an apparatus body of an image forming apparatus in a state where a photosensitive member is included in the apparatus body. The developing cartridge includes a developing member configured to carry toner to be supplied to the photosensitive member, a developing frame supporting the developing member so that the developing member is rotatable about a rotation axis, an end member attached to an end of the developing frame in a direction of the rotation axis so that the end member is swingable with respect to the developing frame, wherein a swing axis of the end member extending in a direction along the rotation axis, and a restricting portion configured to restrict a swing movement of the end member with respect to the developing frame. The restricting portion includes a restricting member configured to be movable in a direction along the swing axis from a restricting position at which the restricting member restricts the swing movement of the end member to a non-restricting position at which the restricting member does not restrict the swing movement, and a pressing member configured to move the restricting member from the restricting position to the non-restricting position by pressing the restricting member while moving in a direction intersecting the swing axis, in a case where the restricting portion receives a force from outside of the developing cartridge.

Further features of the present invention will become apparent from the following description of exemplary embodiments with reference to the attached drawings.

DESCRIPTION OF THE EMBODIMENTS

[Overall Schematic Configuration of Image Forming Apparatus]

(Image Forming Apparatus)

Figure 1:
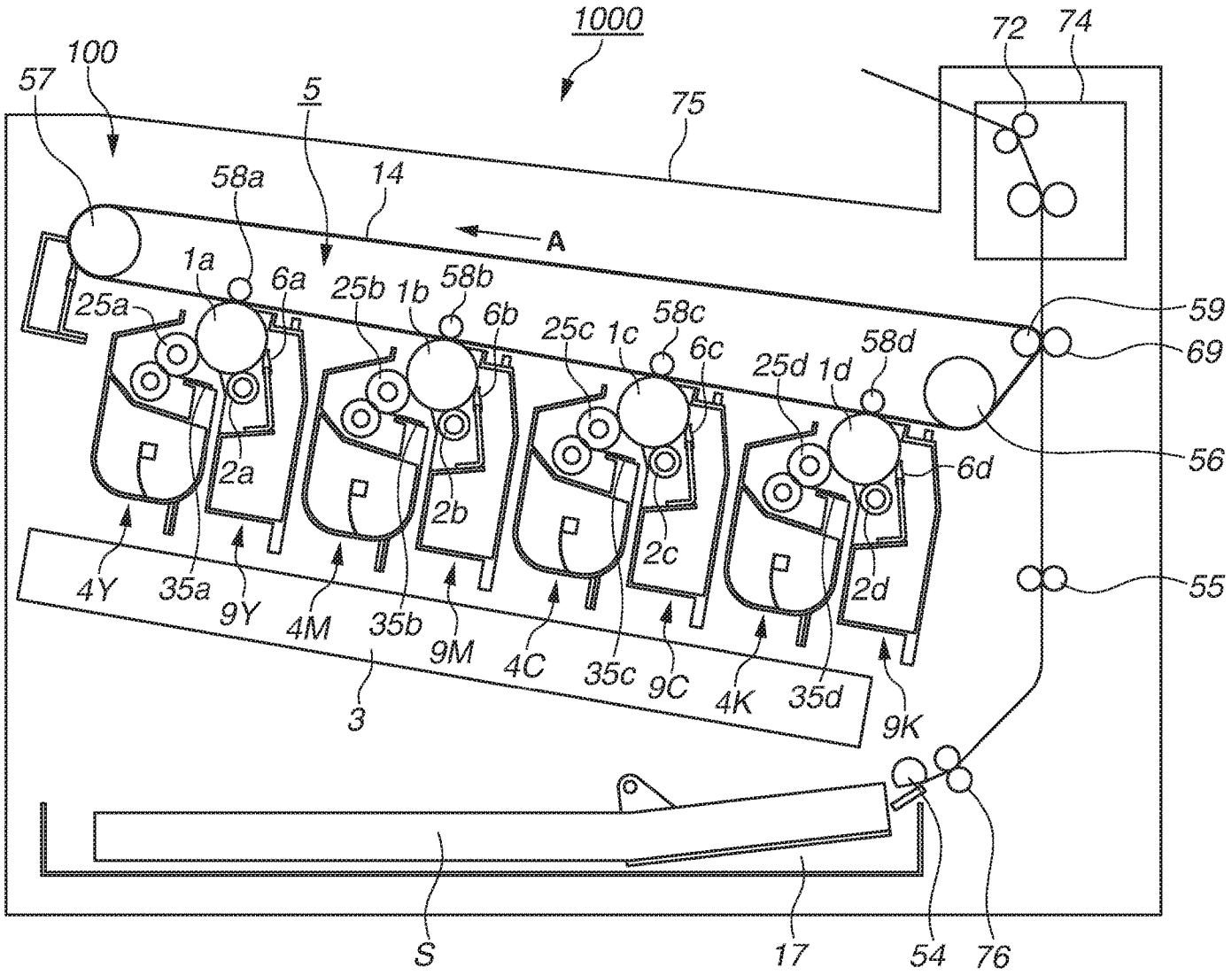
FIG. 1 is a schematic section view of an image forming apparatus according to an exemplary embodiment.

An overall configuration of an image forming apparatus 1000 according to an exemplary embodiment is described with reference to FIG. 1. As illustrated in FIG. 1, the image forming apparatus 1000 includes drum cartridges 9 (9Y, 9M, 9C, and 9K, hereinafter denoted by 9Y to 9K) and developing cartridges 4 (4Y, 4M, 4C, and 4K, hereinafter denoted by 4Y to 4K) that are attachable to and detachable from an apparatus body 100.

Each of the drum cartridges 9 includes a photosensitive drum 1 (1*a*, 1*b*, 1*c*, and 1*d*, hereinafter denoted by 1*a* to 1*d*) as an image carrier carrying a toner image. Each of the drum cartridges 9 further includes a charging roller 2 (2*a*, 2*b*, 2*c*, and 2*d*, hereinafter denoted by 2*a* to 2*d*) and a cleaning member 6 (6*a*, 6*b*, 6*c*, and 6*d*, hereinafter denoted by 6*a* to 6*d*). Each of the developing cartridges 4 includes a developing roller 25 (25*a*, 25*b*, 25*c*, and 25*d*, hereinafter denoted by 25*a* to 25*d*) as a developing member, and a developing blade 35 (35*a*, 35*b*, 35*c*, and 35*d*, hereinafter denoted by 35*a* to 35*d*) as a cleaning member.

The charging roller 2 charges the surface of the photosensitive drum 1, and the developing roller 25 develops a latent image formed on the surface of the photosensitive drum 1, with developer (hereinafter, referred to as toner) to form a visible image. The cleaning member 6 removes toner remaining on the photosensitive drum 1 after the toner image formed on the photosensitive drum 1 is transferred to a recording medium S.

An attaching/detaching direction (mounting direction) of the drum cartridge 9 on the apparatus body 100 is a direction along a rotation axis direction of the photosensitive drum 1. An attaching/detaching direction (mounting direction) of the developing cartridge 4 on the apparatus body 100 is a direction along a rotation axis direction of the developing roller 25. An upstream side of the drum cartridge 9 and the developing cartridge 4 in the mounting direction is defined as a front side, and a downstream side thereof in the mounting direction is defined as a rear side.

A scanner unit 3 is provided below the drum cartridge 9 and the developing cartridge 4. The scanner unit 3 performs a selective exposure on the photosensitive drum 1 based on image information to form the latent image on the photosensitive drum 1.

A cassette 17 that accommodates the recording medium S is mounted on a lower part in a vertical direction inside the apparatus body 100. Further, provided is a plurality of conveyance units that conveys the recording medium S such that the recording medium S passes through a secondary transfer roller 69 and a fixing unit 74 and is discharged to the outside of the apparatus body 100. The secondary transfer roller 69 transfers the toner image to the recording medium S. The fixing unit 74 fixes the toner image transferred to the recording medium S. More specifically, the plurality of conveyance units includes a feeding roller 54, a conveyance roller pair 76, and a registration roller pair 55. The feeding roller 54 separates recording media S in the cassette 17 one by one, and feeds a recording medium S. The conveyance roller pair 76 conveys the fed recording medium S. The registration roller pair 55 synchronizes the toner image to be transferred to the recording medium S with the recording medium S. Further, an intermediate transfer unit 5 is provided above the drum cartridge 9 and the developing cartridge 4 in the vertical direction. The toner image formed on the photosensitive drum 1 (1*a*, 1*b*, 1*c*, and 1*d*) is transferred on to the intermediate transfer unit 5. The intermediate transfer unit 5 includes a driving roller 56, a driven roller 57, primary transfer rollers 58 (58*a*, 58*b*, 58*c*, and 58*d*), and a counter roller 59, and a transfer belt 14 is looped over these rollers. The four primary transfer rollers 58*a* to 58*d* press the transfer belt 14, serving as an intermediate transfer member, against the respective four photosensitive drums 1*a* to 1*d* to bring the transfer belt 14 into contact with the photosensitive drums 1*a* to 1*d*. A voltage is applied to the primary transfer rollers 58, thus transferring the toner image from the photosensitive drum 1 to the transfer belt 14 (primary transfer). A voltage is then applied to the secondary transfer roller 69, thus transferring the toner image transferred on the transfer belt 14, to the recording medium S.

An image forming operation will be described below. The photosensitive drum 1 is rotated, and the charging roller 2 uniformly charges the surface of the photosensitive drum 1. Thereafter, the scanner unit 3 performs the selective exposure on the photosensitive drum 1. Thus, an electrostatic latent image is formed on the surface of the photosensitive drum 1. The electrostatic latent image on the surface of the photosensitive drum 1 is developed as a toner image by the developing roller 25. In synchronization with the image formation, the registration roller pair 55 conveys the recording medium S to a secondary transfer portion in which the counter roller 59 and the secondary transfer roller 69 are in contact with each other with the transfer belt 14 in between. Further, a transfer bias voltage is applied to the secondary transfer roller 69 to secondarily transfer toner images of respective colors on the transfer belt 14, to the recording medium S. Thus, a color image is formed on the recording medium S. The recording medium S on which the color image has been formed is heated and pressurized by the fixing unit 74, and the toner image is accordingly fixed. The recording medium S is then discharged to a discharge unit 75 by a discharge roller 72. The fixing unit 74 is disposed in an upper part of the apparatus body 100.

(Drum Cartridge)

Figure 2A:
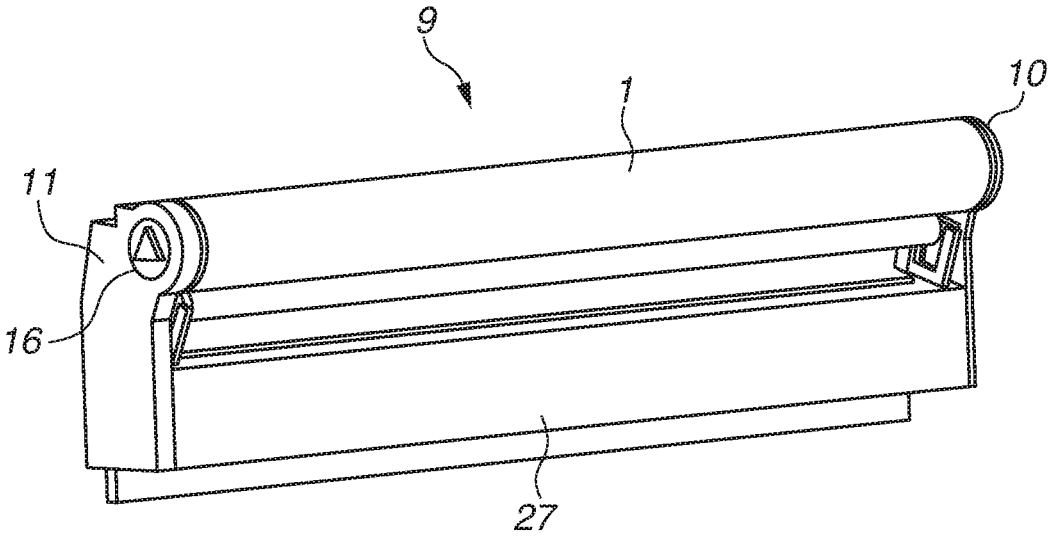
FIGS. 2A and 2B are respectively a perspective view and a schematic section view of a drum cartridge according to an exemplary embodiment.
Figure 2B:
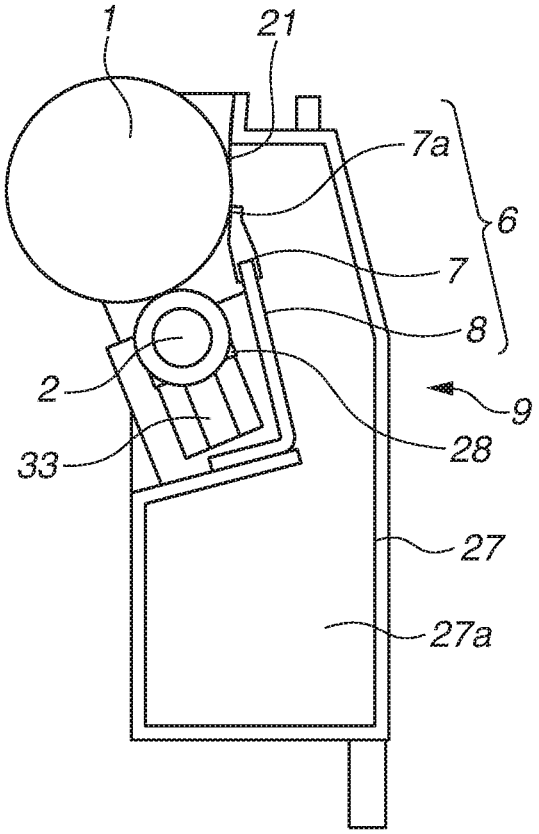

Next, the drum cartridge 9 according to the present exemplary embodiment is described with reference to FIG. 2A and FIG. 2B. FIG. 2A is a perspective view illustrating the appearance of the drum cartridge 9 (9Y to 9K). FIG. 2B is a main cross-sectional view of the drum cartridge 9. The drum cartridges 9Y to 9K have the same configuration. In the present exemplary embodiment, in the mounting direction of each of the drum cartridge 9 and the developing cartridge 4 with respect to the apparatus body 100, described below, an upstream side and a downstream side are respectively defined as a front side and a rear side. The drum cartridge 9 (9Y to 9K) includes the photosensitive drum 1 and a cleaning frame 27. The cleaning frame 27 supports the photosensitive drum 1 via a front-side drum bearing 10 and a rear-side drum bearing 11 in such a manner that the photosensitive drum 1 is rotatable. A drum coupling 16 and a flange are provided on one end side in the rotation axis direction of the photosensitive drum 1. As described above, the charging roller 2 and the cleaning member 6 are provided around the photosensitive drum 1. The cleaning member 6 includes an elastic member 7 made of a rubber blade, and a cleaning support member 8. A leading edge 7*a* of the elastic member (rubber blade) 7 is disposed to be in contact with the photosensitive drum 1 in a direction opposite to a rotational direction. The residual toner removed from the surface of the photosensitive drum 1 by the cleaning member 6 falls into a removed toner chamber 27*a*. Further, a scooping sheet 21 that prevents leakage of the removed toner in the removed toner chamber 27*a* is in contact with the photosensitive drum 1. Driving force from a body driving motor (not illustrated) as a driving source is transmitted to the drum cartridge 9, thus rotationally driving the photosensitive drum 1 based on the image forming operation. The charging roller 2 is rotatably attached to the drum cartridge 9 via a charging roller bearing 28. The charging roller 2 is pressurized against the photosensitive drum 1 by a charging roller pressurizing member 33, and is rotated following the photosensitive drum 1.

(Developing Cartridge)

Figure 3:
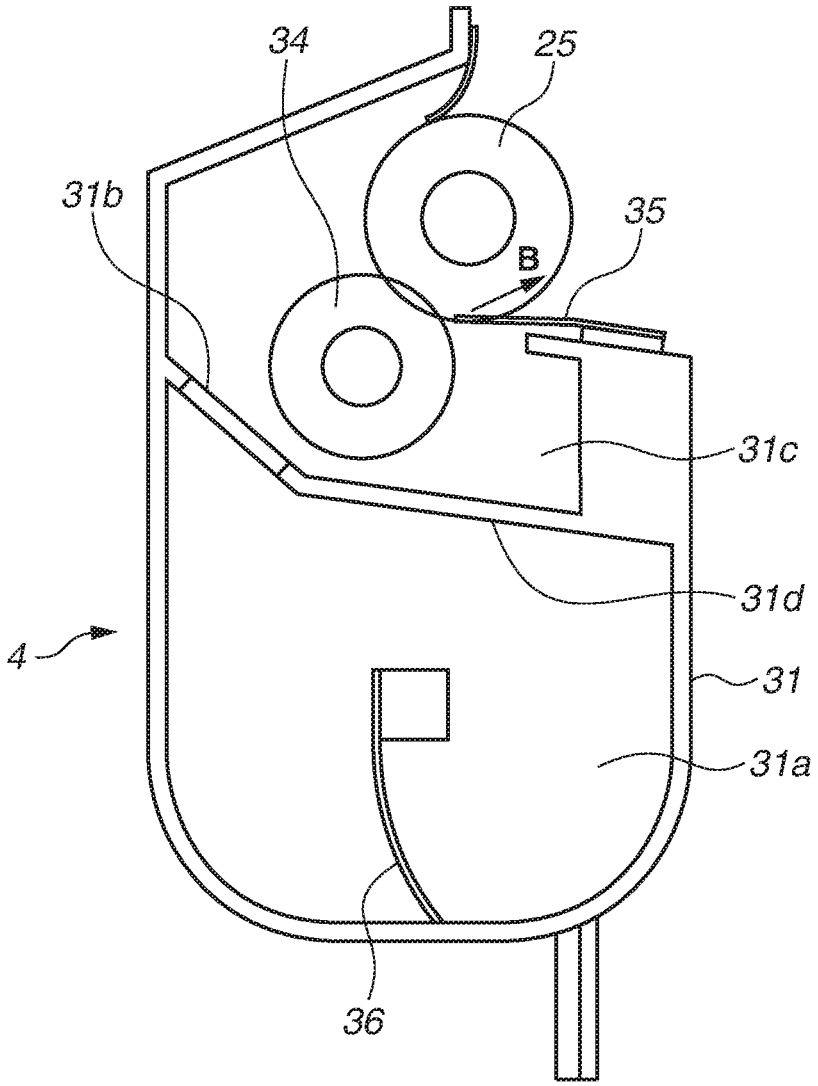
FIG. 3 is a schematic section view of a developing cartridge according to an exemplary embodiment.
Figure 4:
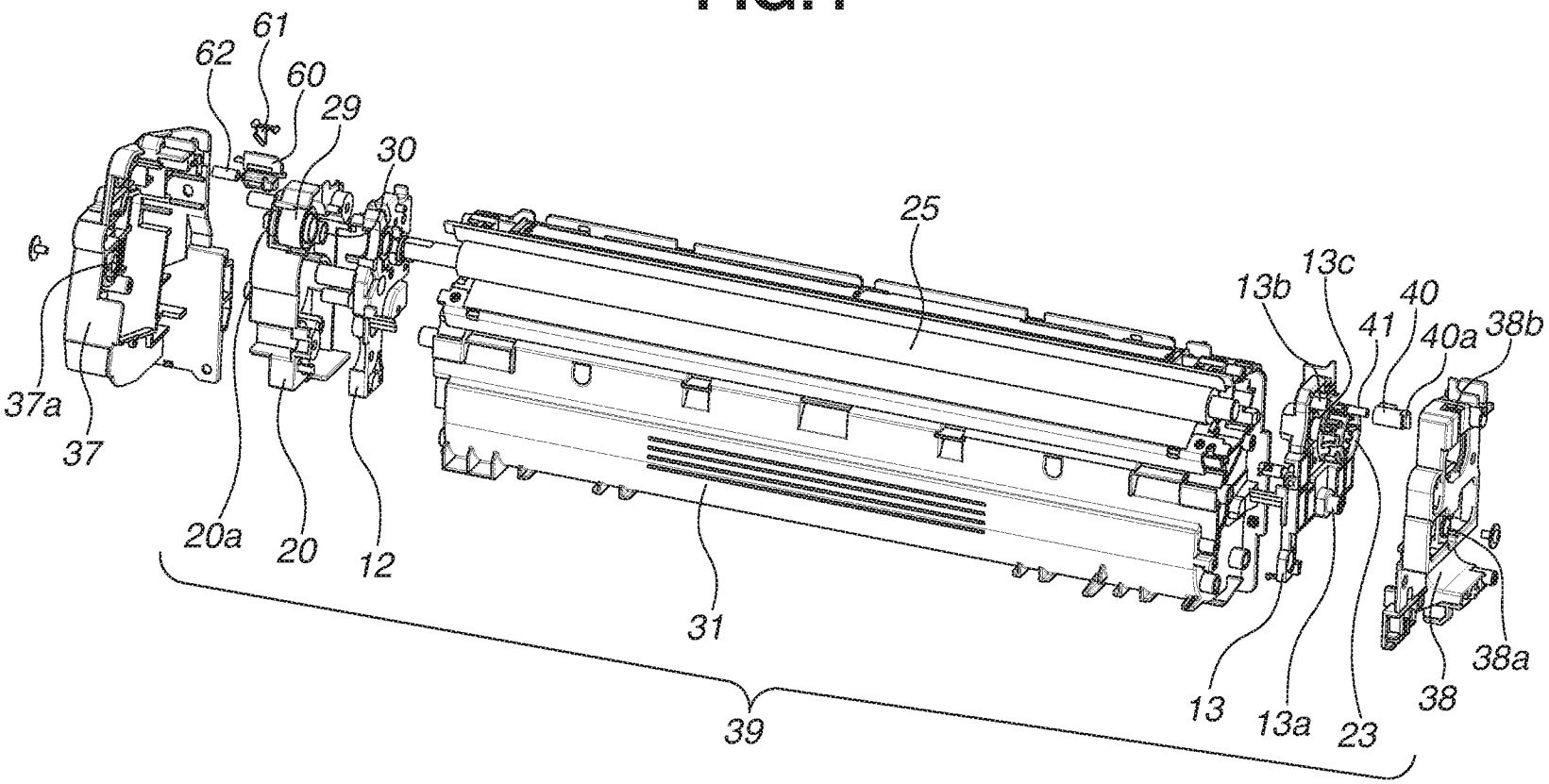
FIG. 4 is an exploded perspective view of the developing cartridge according to an exemplary embodiment.

Next, the developing cartridge 4 will be described with reference to FIG. 3, FIG. 4, and FIGS. 5A and 5B. FIG. 3 is a main cross-sectional view of the developing cartridge 4 (4Y to 4K). FIG. 4 is a perspective view of the developing cartridge 4 that is partially disassembled for the sake of convenience. The developing cartridges 4Y to 4K respectively storing toner of yellow, magenta, cyan, and black have the same configuration.

The developing cartridge 4 includes the developing roller 25 and a developing frame 31. The developing roller 25 supplies toner to the photosensitive drum 1 while rotating in an arrow B direction (in FIG. 3) in contact with the photosensitive drum 1, thereby developing the toner image on the photosensitive drum 1. The developing frame 31 supports the developing roller 25 in such a manner that the developing roller 25 is rotatable. The developing cartridge 4 further includes a toner supply roller 34, the developing blade 35, and a toner conveyance member 36. The toner supply roller 34 supplies the toner to the developing roller 25 while rotating in contact with the developing roller 25. The developing blade 35 regulates a thickness of a toner layer on the developing roller 25. The developing cartridge 4 is attachable to and detachable from the apparatus body 100 in a state where the drum cartridge 9 (photosensitive drum 1) is mounted on the apparatus body 100.

Each of the developing roller 25, the toner supply roller 34, and the developing blade 35 is a member long in the rotation axis direction of the developing roller 25.

The developing frame 31 includes a developing chamber 31*c* and a toner storage chamber 31*a*. The developing chamber 31*c* serves as a developing unit in which the developing roller 25 is disposed. The toner storage chamber 31*a* serves as a toner storage unit that is provided below the developing chamber 31*c* in the vertical direction in a state where the developing cartridge 4 is mounted on the apparatus body 100. The chambers are partitioned by a partition 31*d*. The partition 31*d* has an opening 31*b* through which the toner passes when the toner is conveyed from the toner storage chamber 31*a* to the developing chamber 31*c*.

The toner conveyance member 36 provided in the toner storage chamber 31*a* stirs the stored toner and conveys the toner to the developing chamber 31*c* via the opening 31*b*. Longitudinal ends of each of the developing roller 25 and the toner supply roller 34 are rotatably supported by a front-side developing bearing member 12 and a rear-side developing bearing member 13, as illustrated in FIG. 4. A developing coupling 23 is provided at the rear-side longitudinal end of the toner supply roller 34. A toner supply gear 30 is provided at the front-side longitudinal end of the toner supply roller 34. A developing gear 29, which engages the toner supply gear 30, is provided at the front-side longitudinal end of the developing roller 25. Accordingly, transmitting of the driving force of the body driving motor (not illustrated) as a driving source to the developing coupling 23 rotationally drives the toner supply roller 34 and the developing roller 25 based on the image forming operation. A gear cover 20 as a part of the developing frame 31 is provided outside the developing gear 29 and the toner supply gear 30. Hereinafter, the developing frame 31 and the members supported by the developing frame 31 are collectively referred to as a developing unit 39.

(Front End Member and Rear End Member of Developing Cartridge)

Figure 5B:
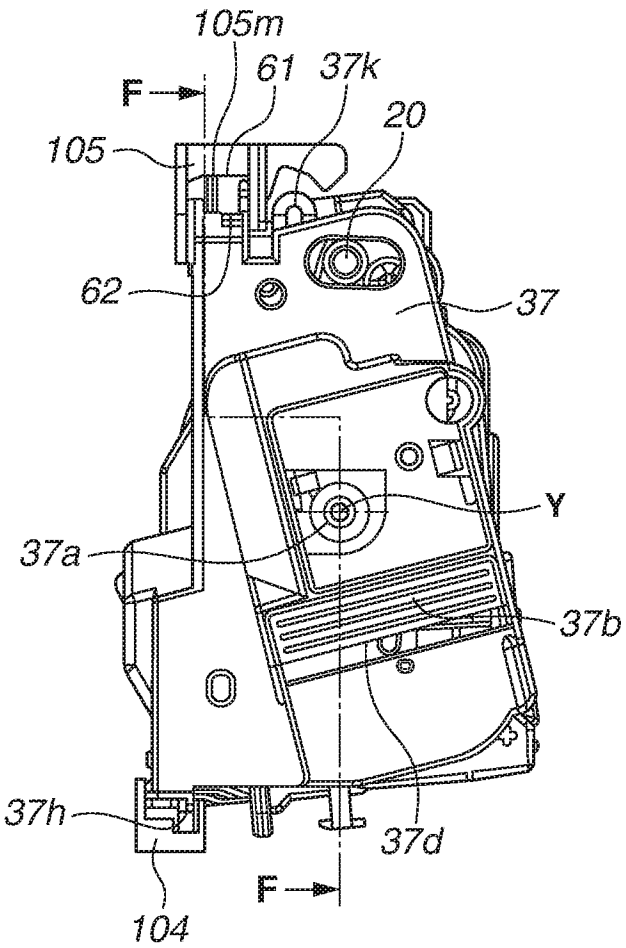
FIGS. 5A and 5B are respectively a rear-side front view and a front-side front view of the developing cartridge according to an exemplary embodiment.
Figure 5A:
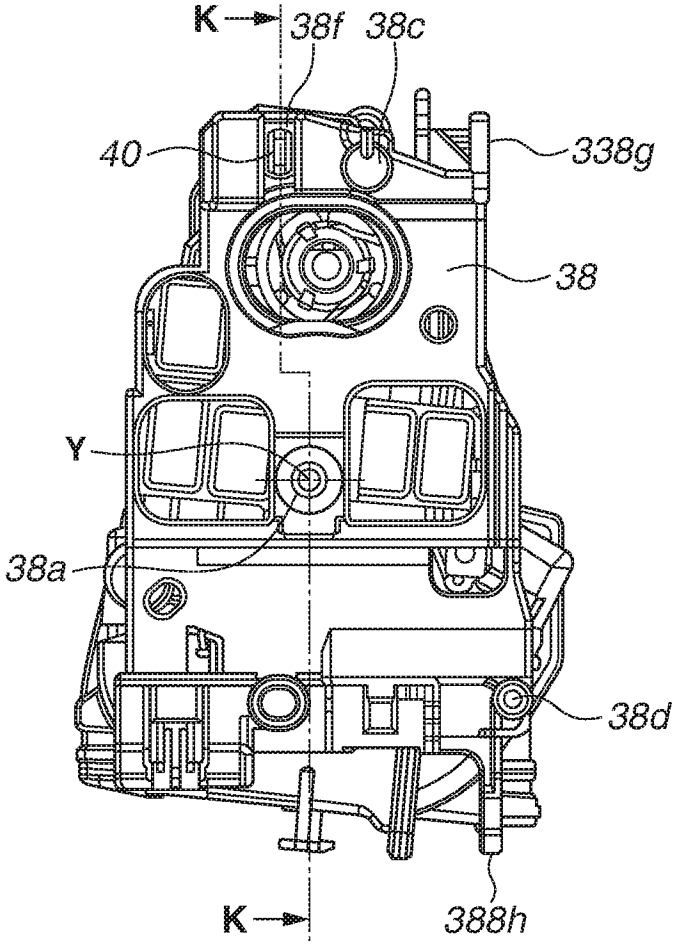

A front end member (first end member) 37 and a rear end member (second end member) 38 are provided at a front-side end and a rear-side end of the developing roller 25 of the developing frame 31, respectively, in the longitudinal direction. FIG. 5A illustrates the developing cartridge 4 as viewed from the rear end member 38 side, and FIG. 5B illustrates the developing cartridge 4 as viewed from the front end member 37 side. As illustrated in FIG. 4, the rear end member 38 includes a hanging hole 38*a*, which engages with a boss 13*a* provided on the rear-side developing bearing member 13. The front end member 37 includes a hanging hole 37*a*, which engages with a boss 20*a* provided on the gear cover 20 as illustrated in FIG. 4. The front end member 37 and the rear end member 38 are attached such that the front end member 37 and the rear end member 38 are rotatable (swingable) about a rotation axis Y (swing axis) that connects the boss 13*a* of the rear-side developing bearing member 13 and the boss 20*a* of the gear cover 20. In other words, the front end member 37 and the rear end member 38 are attached to the developing frame 31 such that the front end member 37 and the rear end member 38 are independently rotatable. The front end member 37 is rotatable with respect to the developing frame 31 and the rear end member 38. The rear end member 38 is rotatable with respect to the developing frame 31 and the front end member 37. In other words, when the front end member 37 rotates with respect to the developing frame 31, the rear end member 38 can be stationary with respect to the developing frame 31 and the front end member 37. When the rear end member 38 rotates with respect to the developing frame 31, the front end member 37 can be stationary with respect to the developing frame 31 and the rear end member 38.

Figure 12:
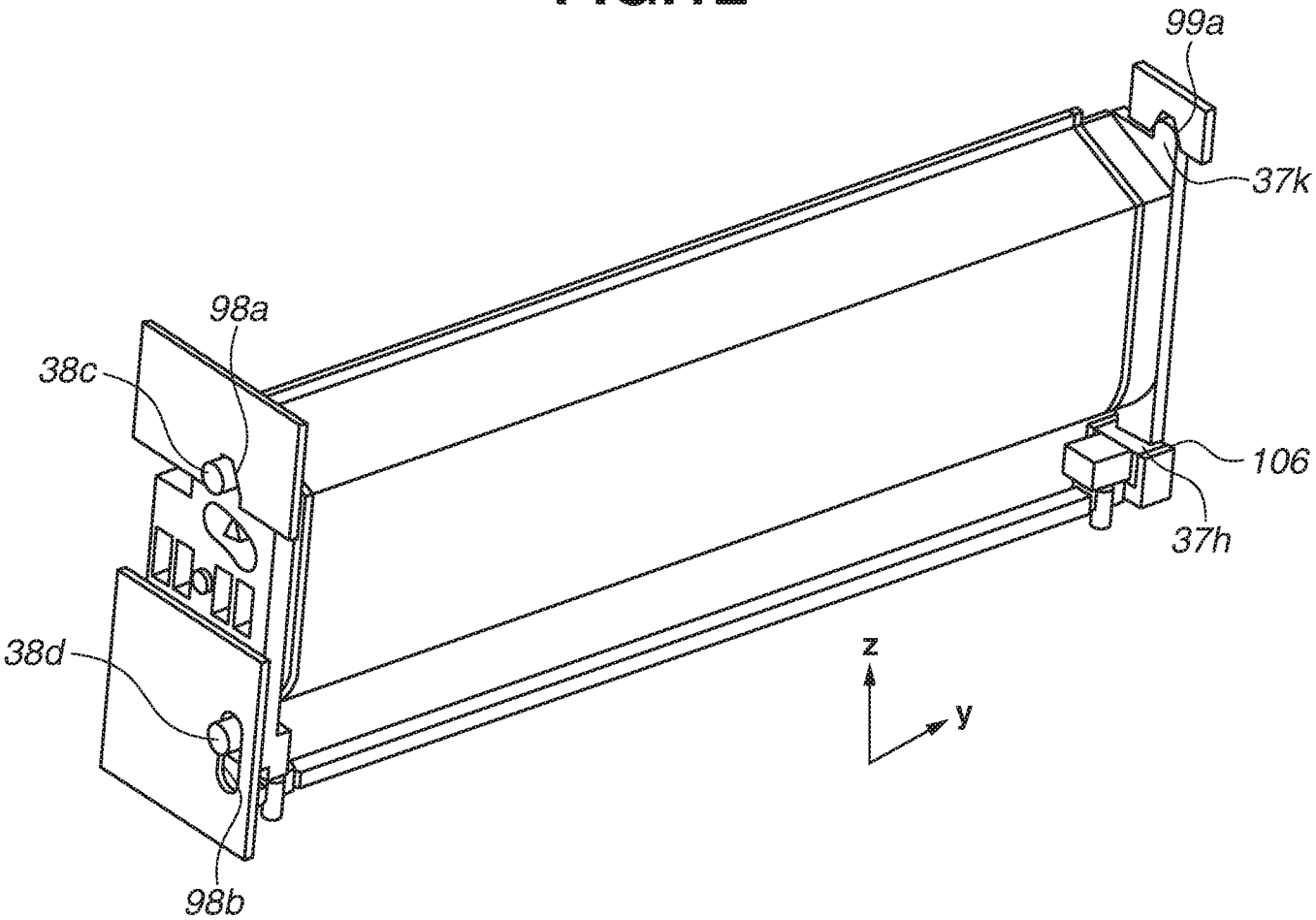
FIG. 12 is a perspective view illustrating a state where the positions of the front-end member and the rear-end member are set with respect to the apparatus body according to an exemplary embodiment.

Next, a configuration of setting the position of the front end member with respect to the apparatus body 100 will be described. As illustrated in FIG. 5B and FIG. 12, the front end member 37 includes a guided portion 37*k* (one-end side positioned portion) and a guided portion 37*h* (one-end side rotation stopper). As illustrated in FIG. 12, the apparatus body 100 includes a body first positioning portion 99*a* (first positioning portion) and a body first rotation stopper 106 (first rotation stopper). In a case where the attachment of the developing cartridge 4 to the apparatus body 100 has been completed and the developing cartridge 4 is at a position enabling an image formation (second position, described below), the guided portion 37*k* and the body first positioning portion 99*a* come into contact, and the guided portion 37*h* and the body first rotation stopper 106 engage with each other. As a result, the position of the front end member 37 is set for a direction intersecting the rotation axis of the developing roller 25 with respect to the apparatus body 100.

The rear end member 38 includes a second positioned portion 38*c* (other-end side positioned portion) and a second rotation stopper 38*d* (other-end side rotation stopper) as illustrated in FIG. 5A and FIG. 12. The apparatus body 100 includes a body second positioning portion 98*a* (second positioning portion) and a body second rotation stopper 98*b* (second rotation stopper) as illustrated in FIG. 12. In a case where the developing cartridge 4 is mounted and is located at the position enabling the image formation (second position, described below), the second positioned portion 38*c* and the body second positioning portion 98*a* come into contact, and the second rotation stopper 38*d* and the body second rotation stopper 98*b* come into contact. Thus, the position of the rear end member 38 is set for the direction intersecting the rotation axis of the developing roller 25 with respect to the apparatus body 100.

(Mounting of Cartridge to Apparatus Body)

Next, operation to mount the developing cartridge 4 to the apparatus body 100 will be described with reference to FIGS. 11A and 11B, FIG. 12, FIG. 13, and FIGS. 14A and 14B.

In the present exemplary embodiment, the developing cartridge 4 (4Y to 4K) is mounted to the apparatus body 100 through an opening 101 (101*a*, 101*b*, 101*c*, and 101*d*) illustrated in FIG. 1 IA. The developing cartridge 4 is mounted to the apparatus body 100 in a direction (arrow F direction) parallel to the rotation axis direction of the developing roller 25 (25*a* to 25*d*).

Figure 11A:
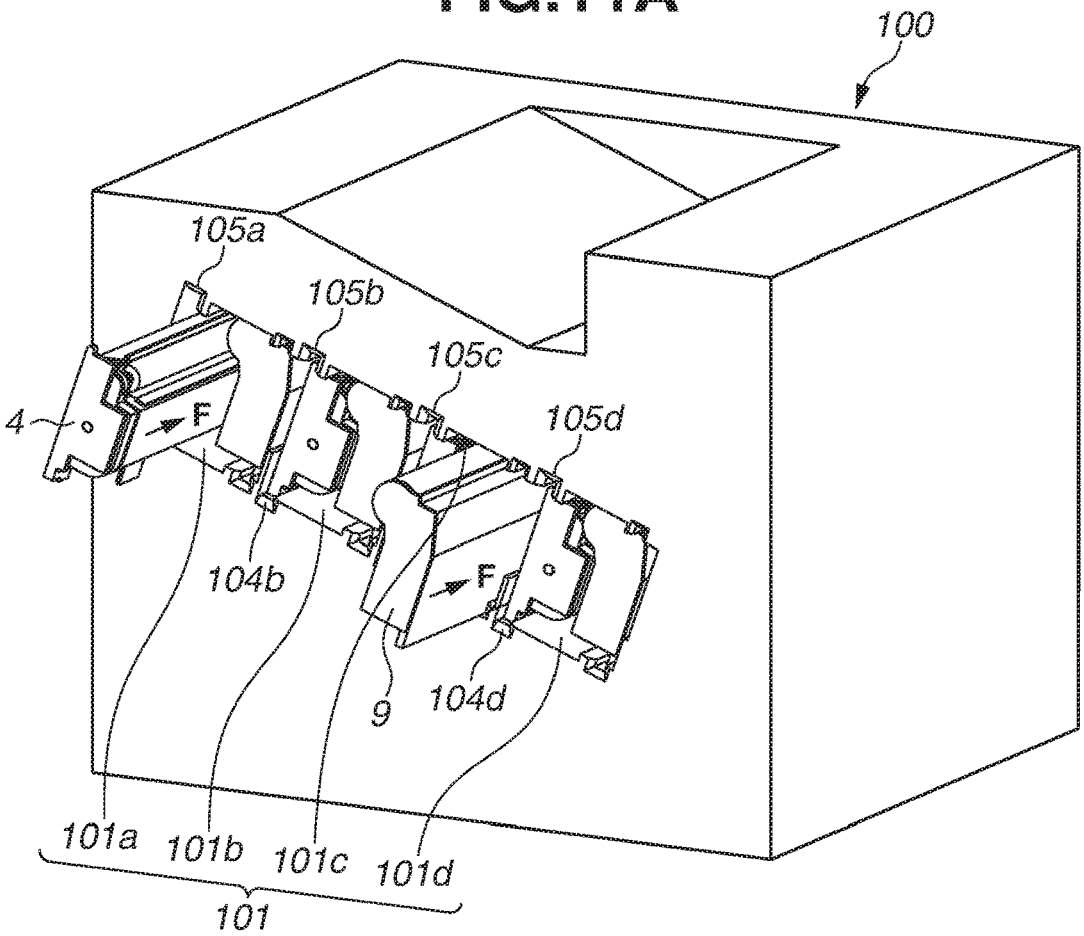
FIGS. 11A and 11B are perspective views illustrating a state where the drum cartridge and the developing cartridge are mounted to an apparatus body according to an exemplary embodiment.
Figure 11B:
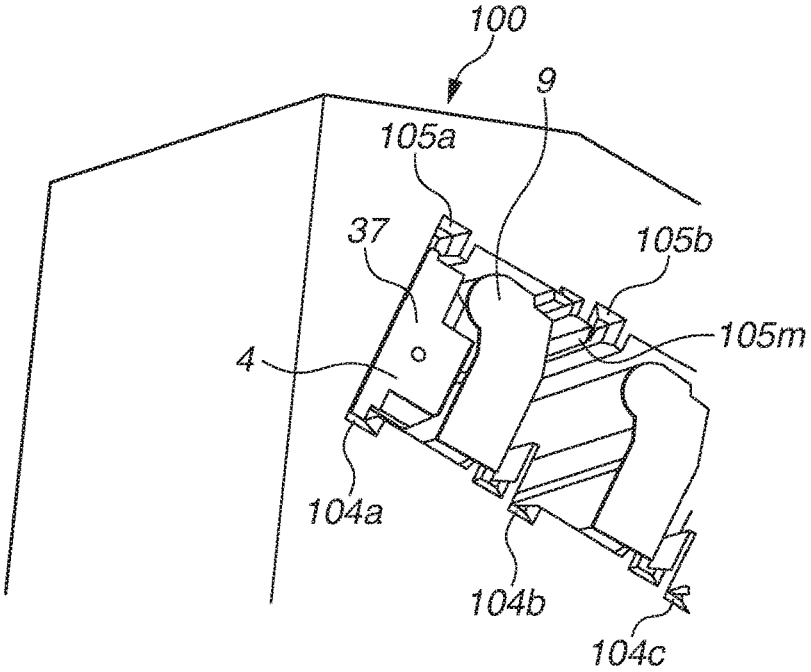
Figure 13:
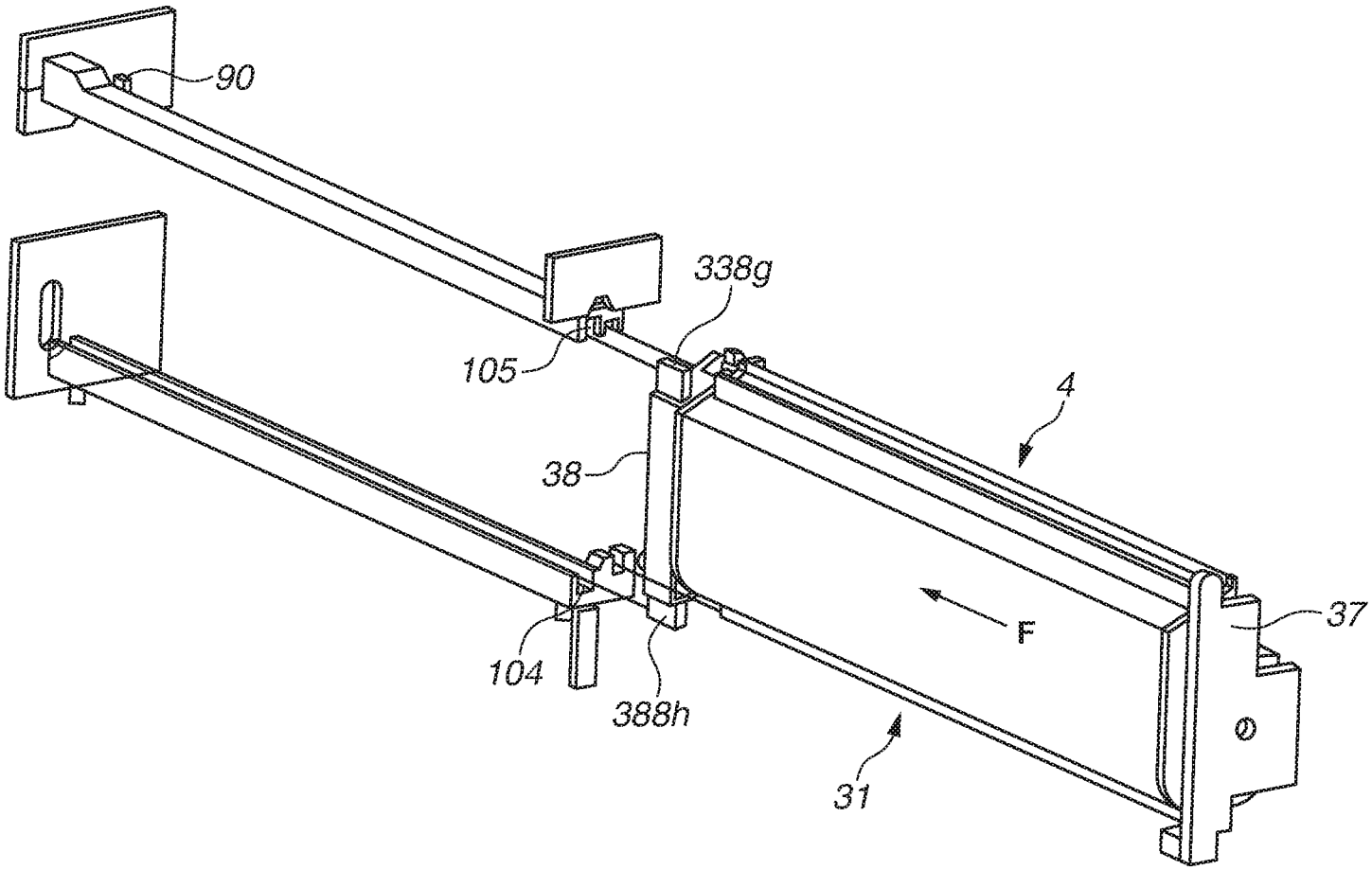
FIG. 13 is a perspective view of the developing cartridge and a guide of the apparatus body according to an exemplary embodiment.
Figure 14A:
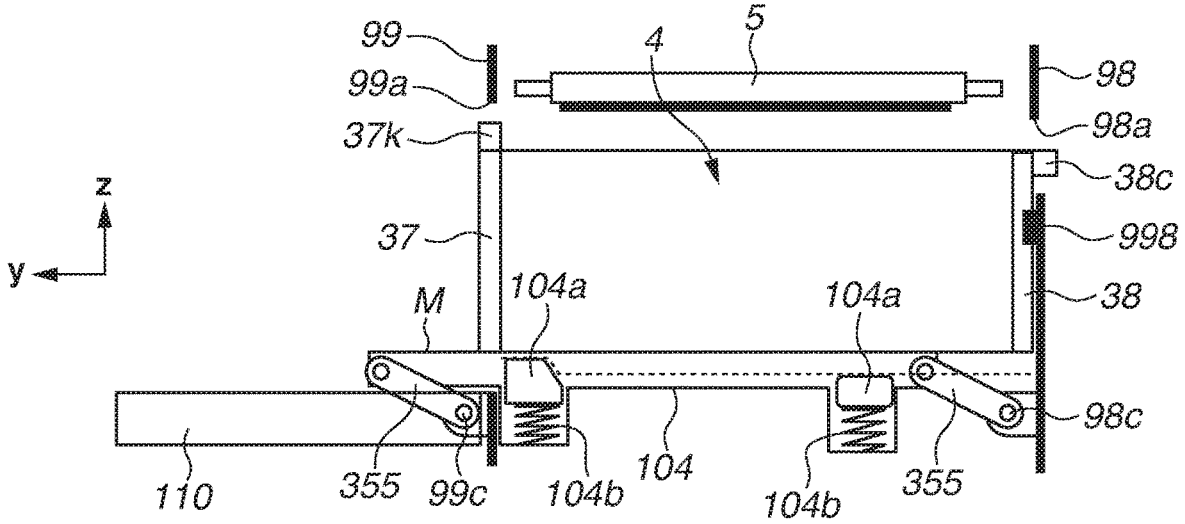
FIGS. 14A and 14B are schematic views respectively illustrating a case where the developing cartridge is located at a first position and a case where the developing cartridge is located at a second position, according to an exemplary embodiment.
Figure 14B:
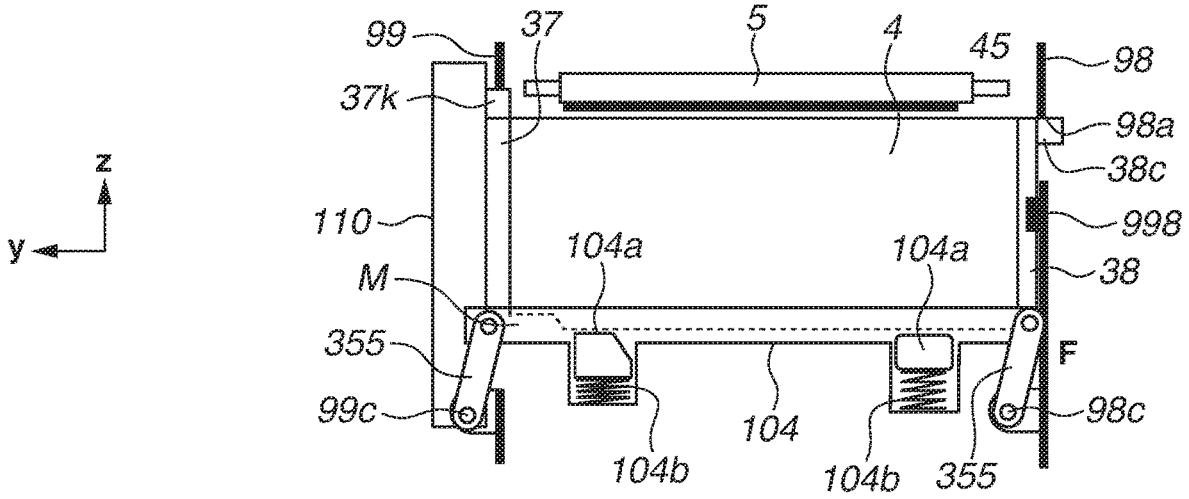

Referring now to FIGS. 14A and 14B, an opening/closing member 110 that is openable and closable with respect to the apparatus body 100 is provided on the front side of the apparatus body 100. When the opening/closing member 110 is opened, the opening 101 is exposed. An upper guide 105 (105*a*, 105*b*, 105*c*, and 105*d*) as a guide member extending in the mounting direction of the developing cartridge 4 is provided on an upper portion of the opening 101 in the vertical direction, as illustrated in FIGS. 11A and 11B and FIG. 13. The upper guide 105 has a cross-section including a groove (recessed part). A lower guide 104 (104*a*, 104*b*, 104*c*, and 104*d*) extending in the mounting direction of the developing cartridge 4 is provided on a lower portion of the opening 101 in the vertical direction. The lower guide 104 has a cross-section including a groove (recessed part).

The developing cartridge 4 is mounted to the apparatus body 100 in the following manner. A lower guide rib 338*h* and an upper guide rib 338*g* provided on the rear end member 38 are respectively engaged with the groove of the lower guide 104 and the groove of the upper guide 105 provided on the apparatus body 100 as illustrated in FIG. 5A and FIG. 13. The developing cartridge 4 is then pushed into the apparatus body 100 in the arrow F direction in FIG. 13.

The apparatus body 100 has a movement mechanism M that moves the developing cartridge 4 between the first position and the second position. The first position is for the attachment and detachment of the developing cartridge 4. The second position is for an image formation and is closer to the intermediate transfer unit 5 than the first position. This movement mechanism M is described with reference to FIGS. 14A and 14B. FIG. 14A illustrates a state where the opening/closing member 110 is opened and the developing cartridge 4 is located at the first position by being pushed in, in the mounting direction, to the first position as described above. FIG. 14B illustrates a state where the opening/closing member 110 is closed and the developing cartridge 4 is located at the second position for an image formation. The movement mechanism (moving unit) M includes the lower guide 104, a pressing member 104*a*, a compression spring 104*b* (urging member), and linkage members 355. The pressing member 104*a* is provided on the lower guide 104, and the developing cartridge 4 is placed on and supported by the upper surface of the pressing member 104*a*. The compression spring 104*b* is provided to urge the pressing member 104*a* vertically upward (in a direction approaching the intermediate transfer unit 5). The linkage members 355 are provided on an upstream side and a downstream side of the developing cartridge 4 in the mounting direction. One end of the linkage member 355 on the upstream side is provided on a front-side plate 99 such that the one end thereof is rotatable around a rotation center 99*c*, and the other end thereof is rotatably provided to the lower guide 104. One end of the linkage member 355 on the downstream side is provided on a rear-side plate 98 such that the one end thereof is rotatable around a rotation center 98*c*, and the other end thereof is rotatably provided on the lower guide 104. When the two linkage members 355 rotate in conjunction with rotation of the opening/closing member 110, the lower guide 104 is moved vertically upward. When the lower guide 104 is moved vertically upward, the developing cartridge 4 placed thereon is moved from the first position to the second position.

When the developing cartridge 4 is located at the first position as illustrated in FIG. 14A, the second positioned portion 38*c* of the rear end member 38 has a clearance with respect to the body second positioning portion 98*a* of the rear-side plate 98, and the guided portion 37*k* of the front end member 37 has a clearance with respect to the body first positioning portion 99*a* of the front-side plate 99. By contrast, when the developing cartridge 4 is located at the second position as illustrated in FIG. 14B, the developing cartridge 4 is urged vertically upward with a pressing force of the compression spring 104*b* via the pressing member 104*a*. The second positioned portion 38*c* of the rear end member 38 comes into contact with the body second positioning portion 98*a* of the rear-side plate 98 while the guided portion 37*k* of the front end member 37 comes into contact with the body first positioning portion 99*a* of the front-side plate 99 with the urging force, and the positions of the front end member 37 and the rear end member 38 are set.

(Rotation Restricting Portion of Rear End member)

Figure 6A:
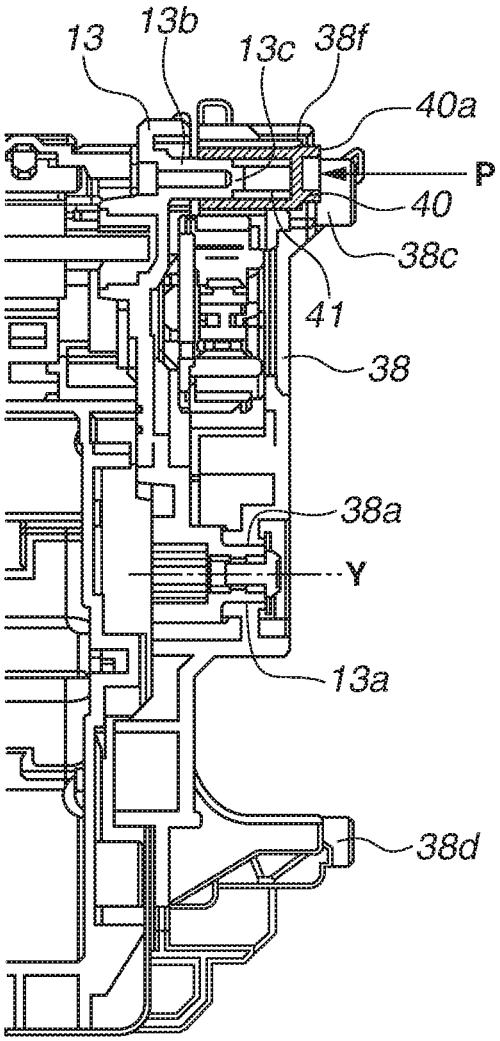
FIGS. 6A and 6B are section views of a vicinity of a rear-end member of the developing cartridge according to an exemplary embodiment.
Figure 6B:
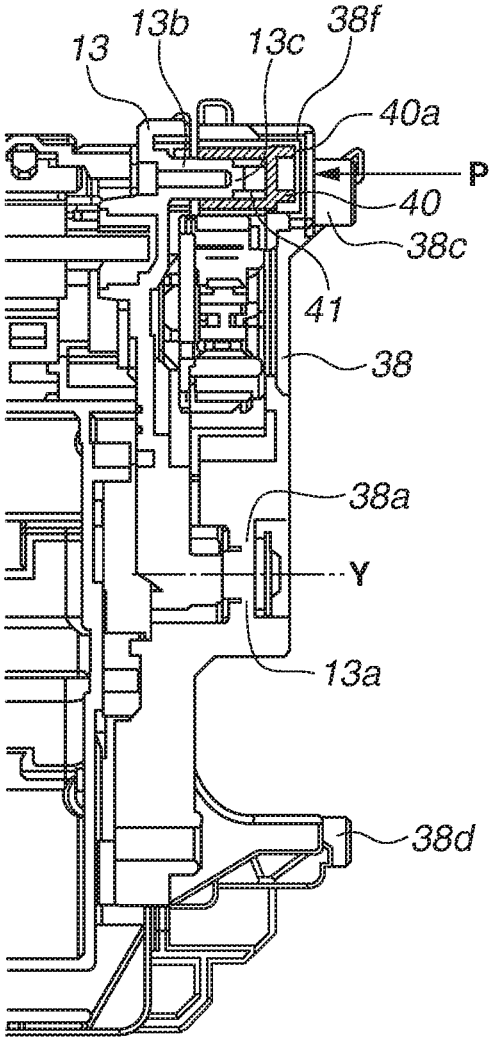

Next, a rear restricting member 40 that restricts rotation of the rear end member 38 with respect to the developing unit 39 will be described with reference to FIG. 4, FIG. 5A, and FIGS. 6A and 6B. FIGS. 6A and 6B are section views of the developing cartridge 4 taken along a line K-K in FIG. 5A.

As illustrated in FIGS. 6A and 6B, the rear restricting member (second restricting member) 40 serving as a rotation restricting portion for the rear end member 38 is provided on the rear-side developing bearing member 13. A compression spring 41 is further provided between the rear restricting member 40 and a spring support portion 13*b* of the developing bearing member 13. The rear end member 38 further includes a groove 38*f*, which is engageable with a restricting portion 40*a* of the rear restricting member 40, and the hanging hole 38*a*. The developing bearing member 13 includes the boss 13*a*, which engages with the hanging hole 38*a*. In a state where the developing cartridge 4 is not mounted to the apparatus body 100, the hanging hole 38*a* and the groove 38*f* of the rear end member 38 respectively engage with the boss 13*a* of the developing bearing member 13 and the restricting portion 40*a* of the rear restricting member 40 (see FIG. 5A and FIGS. 6A and 6B). With this configuration, rotation of the rear end member 38 about the rotation axis Y with respect to the developing bearing member 13 is restricted. In other words, rotation of the rear end member 38 about the rotation axis Y with respect to the developing unit 39 is restricted.

When the developing cartridge 4 is moved in the mounting direction and is mounted to the apparatus body 100, the rear restricting member 40 comes into contact with a protrusion (second restriction releasing portion) 998 (illustrated in FIGS. 14A and 14B) provided on the rear-side plate 98, and is pressed in a P direction illustrated in FIGS. 6A and 6B. As illustrated in FIG. 6B, the rear restricting member 40 is moved in the P direction against the urging force of the compression spring 41, and engagement of the restricting portion 40*a* of the rear restricting member 40 and the groove 38*b* of the rear end member 38 is released. As a result, the rear end member 38 becomes rotatable about the rotation axis Y with respect to the developing frame 31 including the developing bearing member 13 or the developing unit 39.

In the case where the developing cartridge 4 is located at the second position for an image formation, the operation is as follows. As described above, the position of the rear end member 38 has been set for the direction intersecting the rotation axis of the developing roller 25 with respect to the apparatus body 100, and the rotation of the rear end member 38 with respect to the developing unit 39 is not restricted. Thus, in the case where the developing cartridge 4 is located at the second position, the developing unit 39 is rotatable about the rotation axis Y with respect to the rear end member 38 the position of which has been set in the apparatus body 100.

(Rotation Restricting Portion of Front End Member)

Figure 7B:
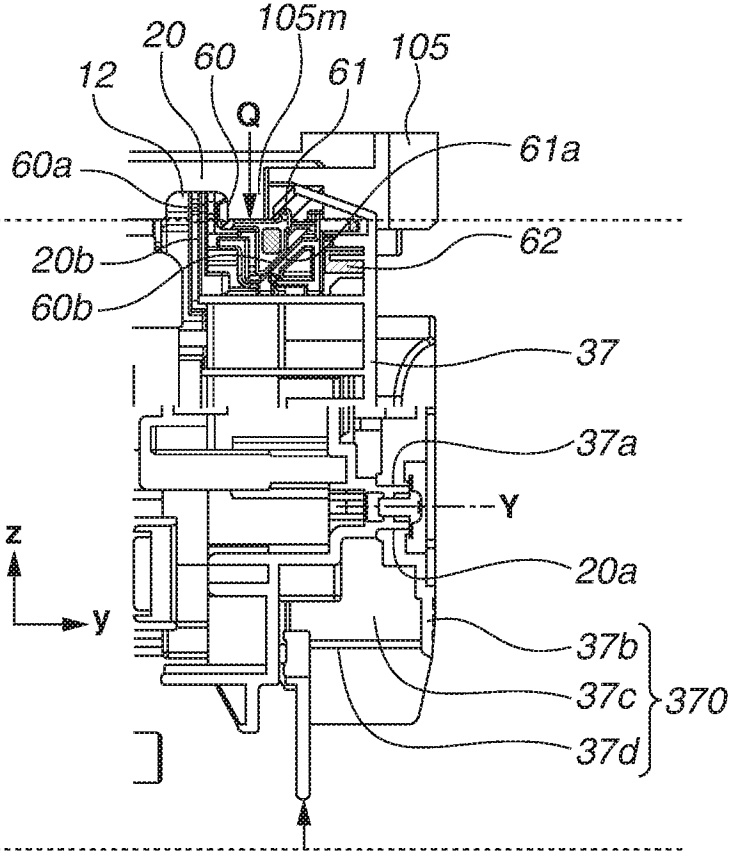
FIGS. 7A and 7B are section views of a vicinity of a front-end member of the developing cartridge according to an exemplary embodiment.
Figure 7A:
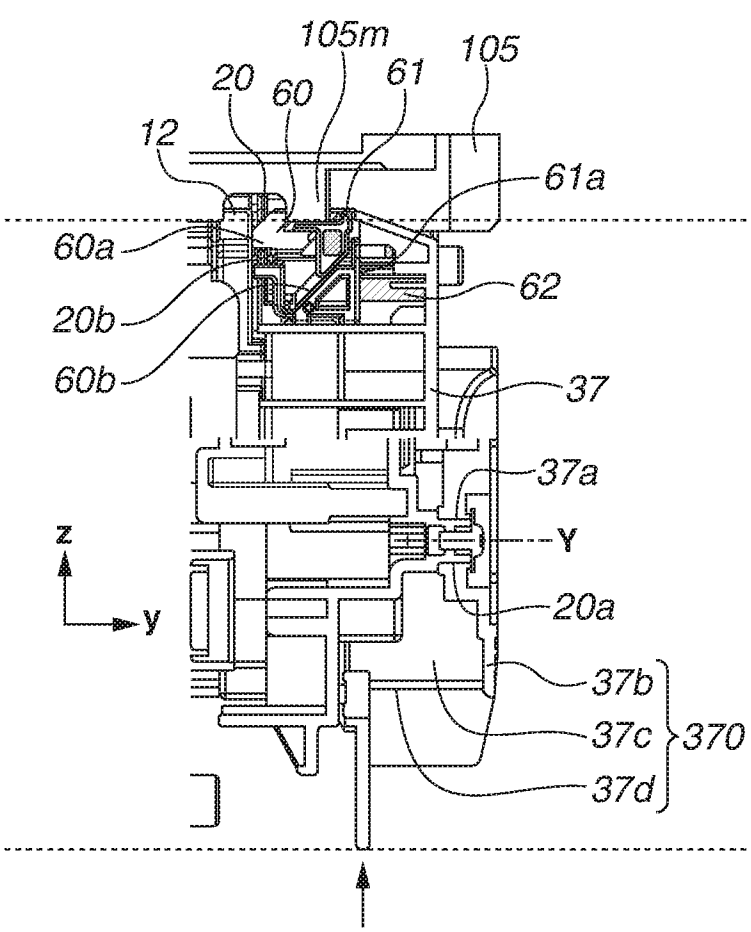
Figure 8A:
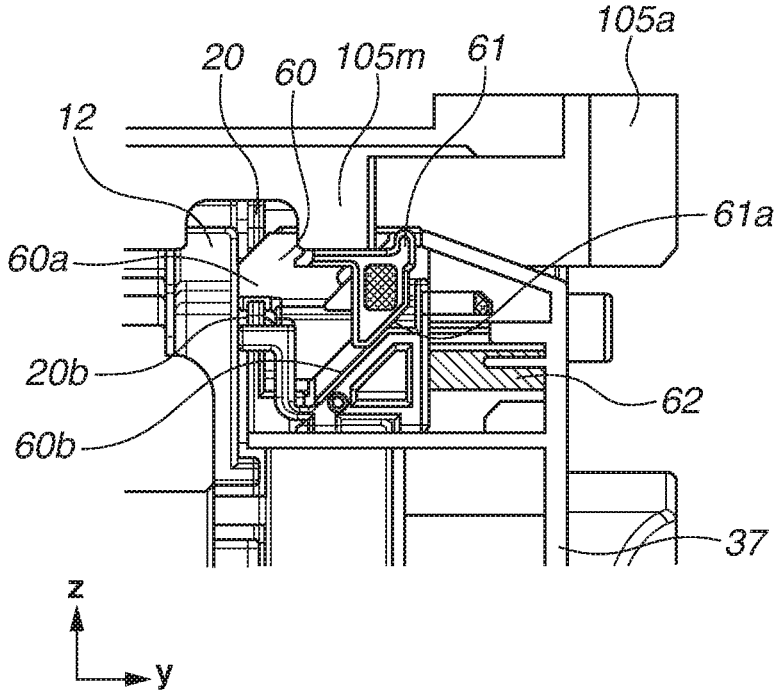
FIGS. 8A and 8B are respectively a section view and a perspective view of a vicinity of a restricting member of the front-end member of the developing cartridge in a case where the restricting member is located at a restricting position.
Figure 8B:
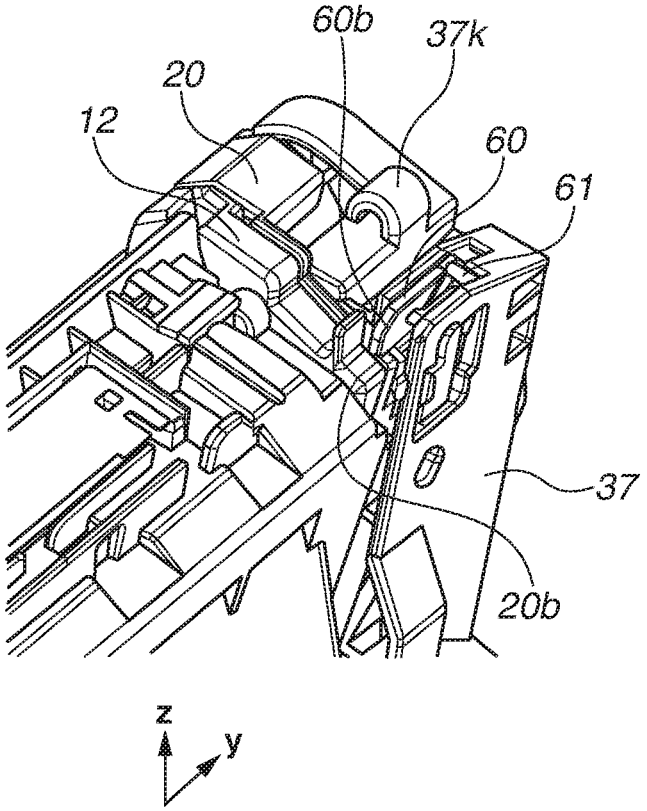
Figure 9A:
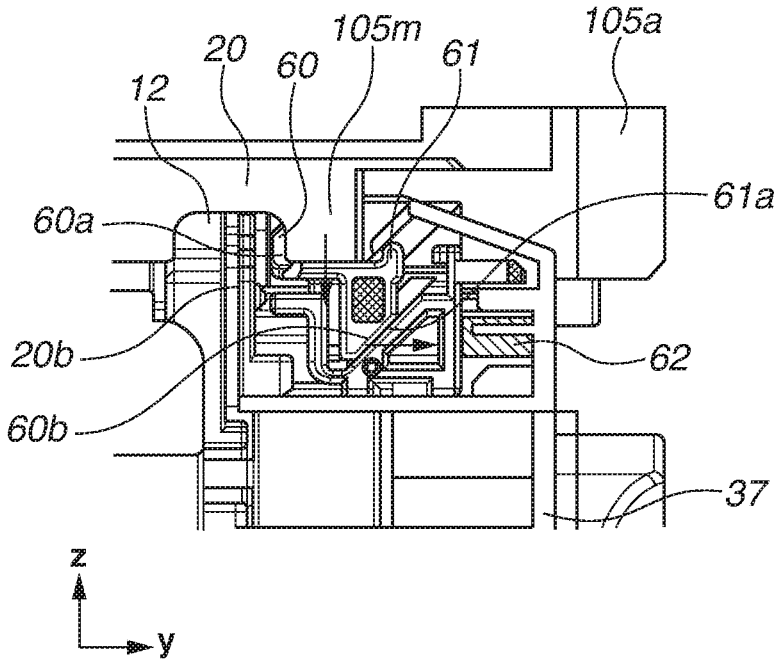
FIGS. 9A and 9B are respectively a section view and a perspective view of a vicinity of the restricting member of the front-end member of the developing cartridge in a case where the restricting member is located at a non-restricting position.
Figure 9B:
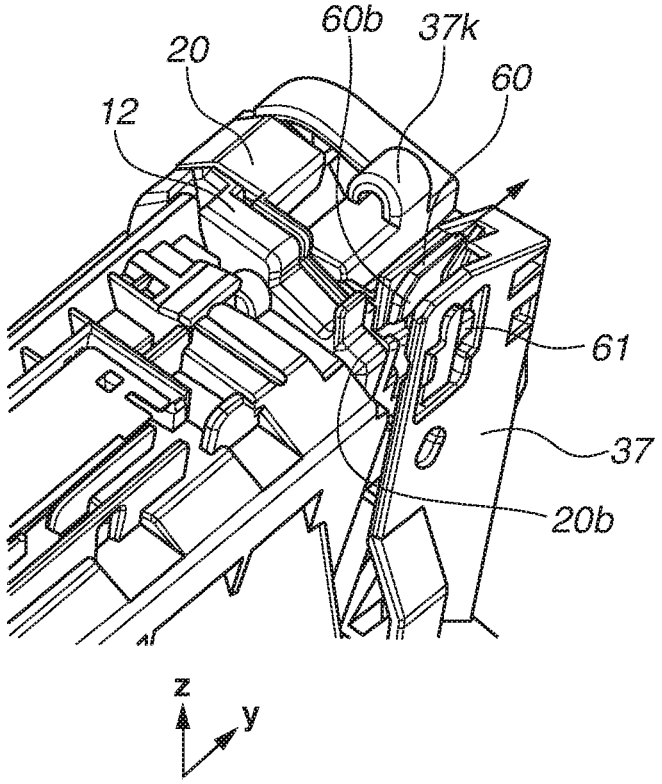

The front end member 37 will be described with reference to FIG. 4, FIG. 5B, and FIGS. 7A to 9B. FIGS. 7A and 7B are section views of the developing cartridge 4 taken along a line F-F illustrated in FIG. 5A in a case where the developing cartridge 4 is located, respectively, at the first position and the second position described above. FIGS. 8A and 8B are respectively a perspective view and a section view of a part of the developing cartridge 4 located at the first position. FIGS. 9A and 9B are respectively a perspective view and a section view of a part of the developing cartridge 4 at the second position.

The front end member 37 includes a front restricting member (first restricting member) 60, a compression spring 62, and a pressing member 61. The front restricting member 60 serves as a rotation restricting portion for the front end member 37 with respect to the developing frame 31 (developing unit 39). The compression spring 62 serves as an urging member urging the front restricting member 60. The pressing member 61 presses the front restricting member 60.

The front restricting member 60 is provided on the front end member 37 such that the front restricting member is movable in the rotation axis direction (y-axis direction) of the developing roller 25. The pressing member 61 is provided on the front end member 37 such that the pressing member 61 is movable in a z-axis direction orthogonal to the y-axis direction. The compression spring 62 is provided between the front restricting member 60 and the front end member 37.

Figure 10A:
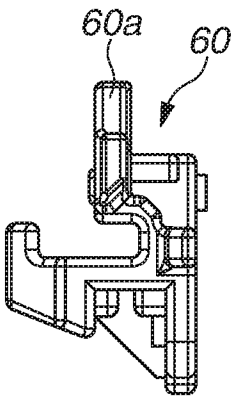
FIGS. 10A to 10F are front views, left side views, and right side views of the restricting member and a pressing member according to an exemplary embodiment.
Figure 10B:
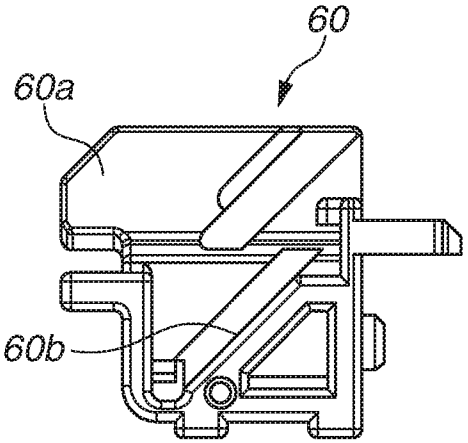
Figure 10C:
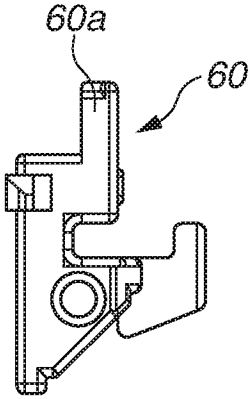
Figure 10D:
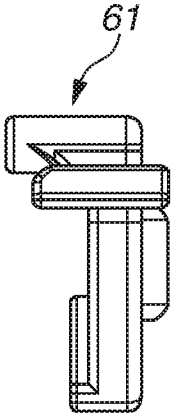
Figure 10E:
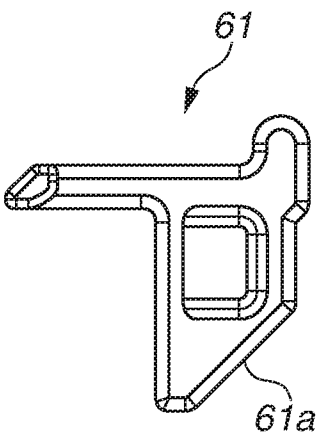
Figure 10F:
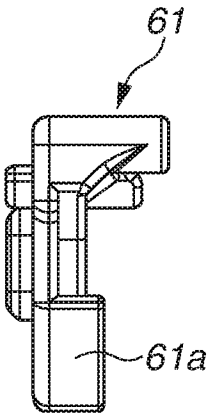

FIGS. 10A to 10F are detailed views illustrating the front restricting member 60 and the pressing member 61. FIGS. 10A, 10B, and 10C are respectively a left side view, a front view, and a right side view of the front restricting member 60. FIGS. 10D, 10E, and 10F are respectively a left side view, a front view, and a right side view of the pressing member 61. The front restricting member 60 includes a restricting portion 60*a* and an inclined-surface portion 60*b*. The pressing member 61 includes an inclined-surface portion 61*a*.

In the case where the developing cartridge 4 is located at the first position, the front restricting member 60 of the front end member 37 is urged in −Y direction by the urging force of the compression spring 62, and the restricting portion 60*a* of the front restricting member 60 engages with a groove 20*b* provided on the gear cover 20, as illustrated in FIG. 7A and FIGS. 8A and 8B. When the restricting portion 60*a* engages with the groove 20*b* in this way, the rotation of the front end member 37 about the Y axis with respect to the developing unit 39 (developing frame 31) is restricted. In other words, the rotation of the developing unit 39 (developing frame 31) about the Y axis with respect to the front end member 37 is restricted.

In a case where the developing cartridge 4 is lifted from the first position in the z direction by the lower guide 104 of the apparatus body 100 and is located at the second position, the operation is as follows. As illustrated in FIG. 7B, the pressing member 61 receives force in a Q direction orthogonal to the axis direction of the developing roller 25 by a restriction releasing portion 105*m* provided on the front side of the upper guide 105 of the apparatus body 100. When the pressing member 61 is pressed in the Q direction, the pressing member 61 is moved in −z direction. The inclined-surface portion 61*a* of the pressing member 61 presses the inclined-surface portion 60*b* of the front restricting member 60, and the front restricting member 60 is moved in the y direction against the urging force of the compression spring 62. When the front restricting member 60 is moved in the y direction, engagement of the restricting portion 60*a* of the front restricting member 60 and the groove 20*b* of the gear cover 20 is released. When engagement of the restricting portion 60*a* and the groove 20*b* is released in this way, the developing unit 39 (developing frame 31) becomes rotatable about the Y axis. In other words, the front restricting member 60 is configured to be movable between the restricting position (FIG. 7A and FIG. 8) at which a rotation of the front end member 37 is restricted with respect to the developing unit 39 (developing frame 31), and the non-restricting position (FIG. 7B and FIG. 9) at which the rotation thereof is not restricted. The front restricting member 60 is located at the restricting position when the developing cartridge 4 is located at the first position, and the front restricting member 60 is located at the non-restricting position when the developing cartridge 4 is located at the second position. As described above, even if the developing cartridge 4 is pushed into, in the mounting direction, until coming into contact with the rear-side plate 98, with a state where the developing cartridge 4 is located at the first position, the rotation of the front end member 37 with respect to the developing unit 39 (developing frame 31) is restricted. The restriction of the rotation for the front end member 37 with respect to the developing unit 39 (developing frame 31) is configured to be released while the opening/closing member 110 is closed and the developing cartridge 4 is moved by the lower guide 104 in the z direction toward the second position.

(Contacting/Separating Operation of Developing Roller)

Figure 15B:
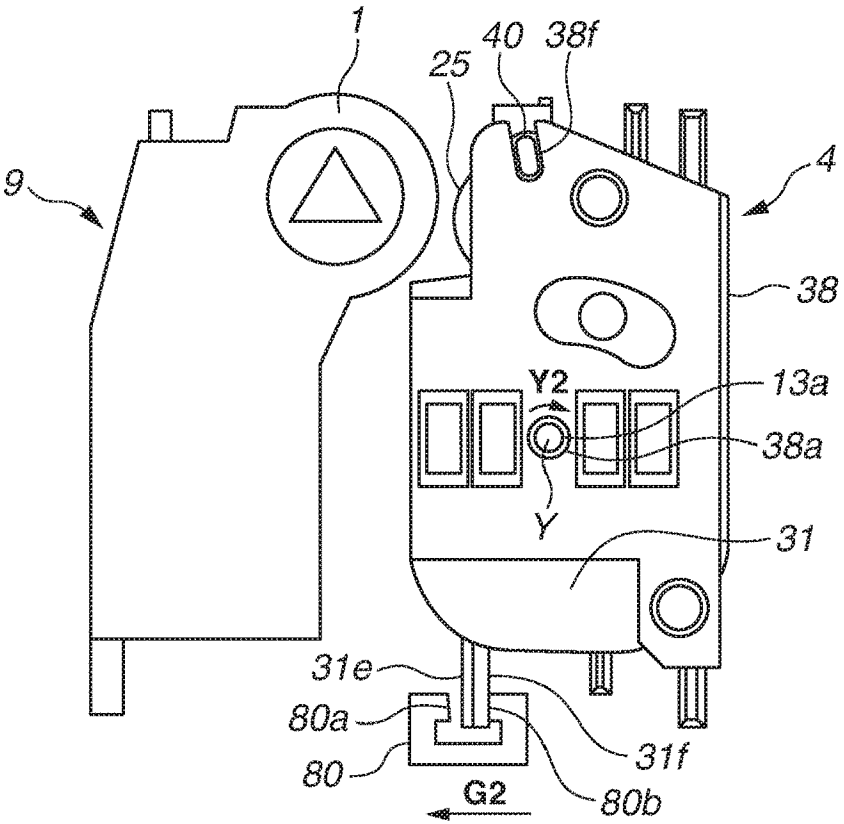
FIGS. 15A and 15B are front views respectively illustrating a contact state and a separated state of the developing cartridge according to an exemplary embodiment.
Figure 15A:
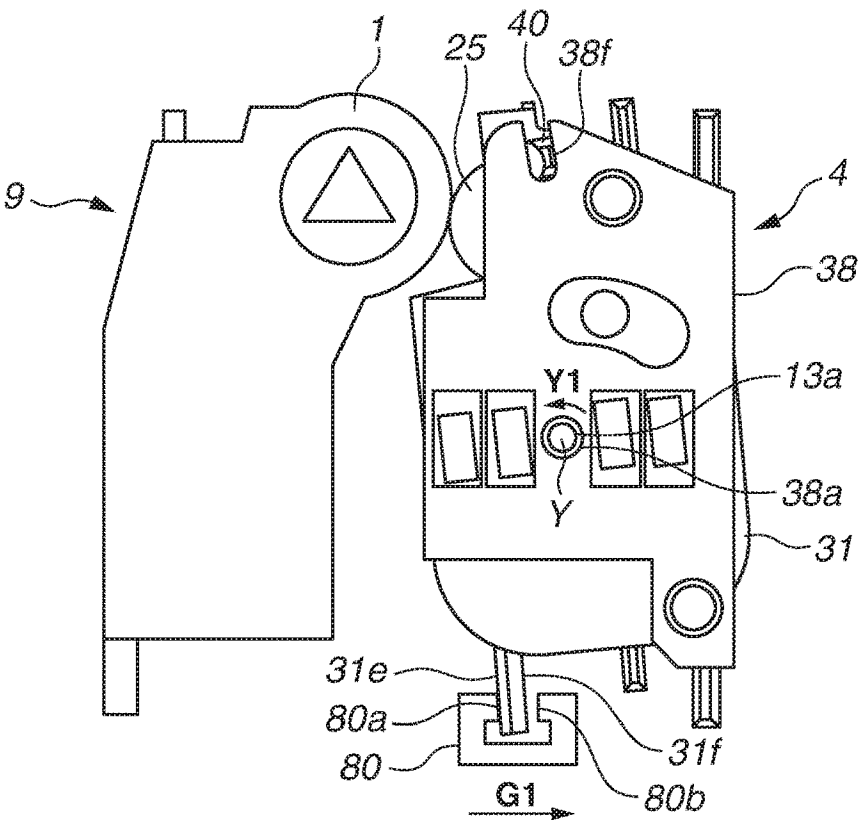

Next, a configuration in which the developing roller 25 comes into contact with and is separated from the photosensitive drum 1 according to the present exemplary embodiment will be described with reference to FIGS. 15A and 15B. FIG. 15A illustrates a state where the developing roller 25 and the photosensitive drum 1 are in contact with each other, and FIG. 15B illustrates a state where the developing roller 25 and the photosensitive drum 1 are separated.

A pressure receiving portion 31*e* that receives pressure from the apparatus body 100 is provided on a lower part of the developing frame 31. A pressurizing member 80 that is movable in a G1 direction and a G2 direction in FIGS. 15A and 15B is provided on the apparatus body 100.

As described above, in a case where the developing cartridge 4 is located at the second position, the positions of the rear end member 38 and the front end member 37 are set for the rotation axis direction of the developing roller 25 with respect to the apparatus body 100. In a case where the developing cartridge 4 is located at the second position, the restriction of the rotation for the rear end member 38 and the restricting member 340 with respect to the developing frame 31 is released. In other words, the developing frame 31 is rotatable about the Y axis with respect to the apparatus body 100. When the pressurizing member 80 is moved in the G1 direction as illustrated in FIG. 15A in this state, a pressurizing portion 80*a* of the pressurizing member 80 comes into contact with the pressure receiving portion 31*e*. As a result, the developing frame 31 swings in an arrow Y1 direction, and the developing roller 25 presses the photosensitive drum 1 with a predetermined pressure. In a case where the pressurizing member 80 is moved in the G2 direction as illustrated in FIG. 15B, a separation portion 80*b* of the pressurizing member 80 comes into contact with a pressure receiving portion 31*f*, which causes the developing frame 31 to swing in an arrow Y2 direction. Thus, the developing roller 25 and the photosensitive drum 1 are separated from each other. When the developing cartridge 4 is located at the second position but an image is not formed on the recording medium S, such a configuration makes it possible to separate the developing roller 25 and the photosensitive drum 1 from each other. This makes it possible to prevent or reduce degradation of image quality caused by deformation of the developing roller 25.

(Position of Rotation Restricting Portion with Respect to Handle of Developing Cartridge)

The developing cartridge discussed in Japanese Patent Application Laid-Open No. 2017-173805 includes a restricting member and a handle for a user to hold the developing cartridge, on a front-side longitudinal end surface. Furthermore, the restricting member is located on the side opposite to an opening of the handle. Accordingly, when the user holds the handle of the developing cartridge, the user erroneously touches the restricting member, which releases the restriction of the rotation for an end member, and the end member and a support unit relatively rotate. This makes it difficult to mount the developing cartridge to an apparatus body. According to the present exemplary embodiment, as illustrated in FIG. 5B and FIGS. 7A and 7B, a handle 370 for the user to hold the developing cartridge 4 to mount the developing cartridge 4 to the apparatus body 100 is provided on the front end member 37 of the developing cartridge 4. The handle 370 includes a wall 37*b* extending in the −z direction in FIGS. 7A and 7B, a recessed part 37*c* extending in the z direction, and an opening 37*d* of the recessed part 37*c*. The opening 37*d* has a size enough to enable at least a finger of the user to be inserted.

The front restricting member 60 and the pressing member 61 provided on the front end member 37 are provided on the side opposite to the opening 37*d* of the handle 370 in the z direction (direction intersecting rotation axis direction of developing roller 25). In other words, the front end member 37 includes the handle that has a recessed part recessed in the direction intersecting the rotation axis Y of the front end member 37, and the front restricting member 60 is provided on the side opposite to the opening 37*d* in the direction intersecting the rotation axis Y. In the present exemplary embodiment, in a case where the developing cartridge 4 is mounted to the apparatus body 100, the opening 37*d* of the handle 370 is directed vertically downward, and the rotation restricting unit (front restricting member 60 and pressing member 61) is provided above the opening 37*d* in the vertical direction.

Thus, it is possible to prevent the user from erroneously releasing the restriction of the rotation of the front end member 37 with respect to the developing frame 31 when the user hooks a finger in the handle 370 of the developing cartridge 4.

In a case where the prevention of erroneous operation by the user is intended, the configuration restricting the rotation of the front end member 37 with respect to the developing frame 31 is not limited to the configuration according to the present exemplary embodiment. For example, the configuration restricting the rotation of the rear end member 38 with respect to the developing frame 31 may be applied to the front end member 37.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2018-178956, filed Sep. 25, 2018, and No. 2018-178957, filed Sep. 25, 2018, which are hereby incorporated by reference herein in their entirety.

What is claimed is:

1. An image forming apparatus forming a toner image on a recording medium, the image forming apparatus comprising:

a photosensitive member configured to carry the toner image;

a drum frame supporting the photosensitive member so that the photosensitive member is rotatable;

a developing cartridge including:

a developing member configured to supply toner to the photosensitive member;

a developing frame supporting the developing member so that the developing member is rotatable about a rotation axis;

an end member attached to an end portion of the developing frame in a direction of the rotation axis so that the end member is swingable with respect to the developing frame, wherein a swing axis of the end member extends in a direction along the rotation axis; and a restricting portion configured to restrict a swing movement of the end member; and an apparatus body to and from which the developing cartridge is attachable and detachable in the direction of the rotation axis in a state that the photosensitive member and the drum frame are provided therein, the apparatus body including:

a movement unit configured to move the developing cartridge from a first position to a second position, the first position being a position for attachment and detachment of the developing cartridge to and from the apparatus body, the second position being a position for an image formation;

a positioning portion configured to engage with the end member so that a position of the end member in a swing direction of the end member about the swing axis with respect to the apparatus body is set in a case where the developing cartridge is located at the second position; and a restriction releasing portion configured to release restriction of the swing movement of the end member by acting on the restricting portion of the developing cartridge when the developing cartridge is moved from the first position to the second position together with the movement unit, the restriction releasing portion being provided at a part of the apparatus main body excluding the movement unit, wherein the end portion of the developing frame to which the end member is attached is an upstream-side end portion in an attaching direction in which the developing cartridge is mounted to the apparatus body.

2. The image forming apparatus according to claim 1, wherein the end member does not engage with the positioning portion of the apparatus body in a case where the developing cartridge is located at the first position.

3. The image forming apparatus according to claim 1, wherein, in a case where the end member is regarded as a first end member and the restricting portion is regarded as a first restricting portion, the developing cartridge includes:

a second end member attached to a downstream-side end portion, in the attaching direction, of the developing frame, the second end member being swingable about the swing axis with respect to the developing frame and the first end member; and a second restricting portion configured to restrict a rotation of the second end member, and wherein, in a case where the positioning portion is regarded as a first positioning portion, the apparatus body includes a second positioning portion configured to engage with the second end member so that a position of the second end member in a swing direction of the second end member about the swing axis with respect to the apparatus body is set in a case where the developing cartridge is located at the second position.

4. The image forming apparatus according to claim 3, wherein, in a case where the restriction releasing portion is regarded as a first restriction releasing portion, the apparatus body includes a second restriction releasing portion configured to release restriction of a swing movement of the second end member by acting on the second restricting portion before the developing cartridge, moving in the attaching direction, reaches the first position.

5. The image forming apparatus according to claim 3, wherein the second end member does not engage with the second positioning portion of the apparatus body in a case where the developing cartridge is located at the first position.

6. The image forming apparatus according to claim 1, wherein the restricting portion is provided on the developing cartridge, and includes:

a restricting member configured to be movable in a direction along the swing axis from a restricting position at which the restricting member restricts the swing movement of the end member to a non-restricting position at which the restricting member does not restrict the swing movement; and a pressing member configured to move the restricting member from the restricting position to the non-restricting position by pressing the restricting member while moving in the direction intersecting the swing axis, in a case where the restricting portion receives a force from outside of the developing cartridge.

7. The image forming apparatus according to claim 1, wherein when the developing cartridge is in the second position, the developing frame is swingable with respect to the end member so as to have a contact posture where the developing member is in contact with the photosensitive member and a non-contact posture where the developing member is not in contact with the photosensitive member.

8. The image forming apparatus according to claim 1, further comprising:

a drum cartridge attachable to and detachable from the apparatus body in a state that the developing cartridge is attached to the apparatus body, wherein the drum cartridge includes the photosensitive member and the drum frame.

9. A developing cartridge attachable to and detachable from an apparatus body of an image forming apparatus in a state where a photosensitive member is provided in the apparatus body, the developing cartridge comprising:

a developing member configured to carry toner to be supplied to the photosensitive member;

a developing frame supporting the developing member so that the developing member is rotatable about a rotation axis;

an end member attached to an end portion of the developing frame in a direction of the rotation axis so that the end member is swingable with respect to the developing frame, wherein a swing axis of the end member extending in a direction along the rotation axis; and a restricting portion configured to restrict a swing movement of the end member with respect to the developing frame, the restricting portion including:

a restricting member configured to be movable in a direction along the swing axis from a restricting position at which the restricting member restricts the swing movement of the end member to a non-restricting position at which the restricting member does not restrict the swing movement; and a pressing member configured to move the restricting member from the restricting position to the non-restricting position by pressing the restricting member while moving in a direction intersecting the swing axis, in a case where the pressing member receives a force from outside of the developing cartridge.

10. A developing cartridge attachable to and detachable from an apparatus body of an image forming apparatus in a state where a photosensitive member is provided in the apparatus body, the developing cartridge comprising:

a developing member configured to carry toner to be supplied to the photosensitive member;

a developing frame supporting the developing member so that the developing member is rotatable about a first rotation axis, the developing frame including a developing chamber in which the developing member is provided, and a toner storage chamber storing the toner to be supplied to the developing chamber;

a toner conveyance member to convey the toner from the toner storage chamber to the developing chamber, the toner conveyance member being provided in the toner storage chamber and being rotatable about a second rotation axis;

a driving force receiving portion configured to receive, from the apparatus body, a driving force for rotating the developing member, the driving force receiving portion being provided at a first end of the developing frame in a direction of the first rotation axis;

an end member attached to a second end portion on a side opposite to the first end portion in the direction of the first rotation axis of the developing member so that the end member is swingable with respect to the developing frame, wherein a swing axis of the end member extends in a direction along the first rotation axis; and a restricting portion configured to restrict a swing movement of the end member with respect to the developing frame, the restricting portion including a restricting member configured to be movable from a restricting position at which the restricting member restricts the swing movement of the end member to a non-restricting position at which the restricting member does not restrict the swing movement in a case where the restricting portion receives a force from outside of the developing cartridge, the restricting member being provided at a position closer to the first rotation axis than the second rotation axis in a cross-section perpendicular to the first rotation axis.

* * * * *